US010480879B2

(12) United States Patent
Harris et al.

(10) Patent No.: US 10,480,879 B2
(45) Date of Patent: Nov. 19, 2019

(54) AUTOMATIC MAGAZINE EJECTION FOLLOWER

(71) Applicant: Evolusion Concepts, Inc., San Diego, CA (US)

(72) Inventors: Courtney Harris, San Diego, CA (US); Glenn Banaag, Los Angeles, CA (US); Jason Paik, Whittier, CA (US)

(73) Assignee: Evolusion Concepts, Inc., San Diego, CA (US)

( * ) Notice: Subject to any disclaimer, the term of this patent is extended or adjusted under 35 U.S.C. 154(b) by 0 days.

(21) Appl. No.: 15/730,822

(22) Filed: Oct. 12, 2017

(65) Prior Publication Data

US 2019/0049205 A1 Feb. 14, 2019

Related U.S. Application Data

(63) Continuation of application No. 15/676,029, filed on Aug. 14, 2017, now abandoned.

(51) Int. Cl.

| | |
|---|---|
| ***F41A 9/70*** | (2006.01) |
| ***F41A 9/59*** | (2006.01) |
| ***F41A 3/66*** | (2006.01) |
| ***F41A 9/66*** | (2006.01) |

(52) U.S. Cl.

CPC ..... *F41A 9/70* (2013.01); *F41A 3/66* (2013.01); *F41A 9/59* (2013.01); *F41A 9/66* (2013.01)

(58) Field of Classification Search

None

See application file for complete search history.

(56) References Cited

U.S. PATENT DOCUMENTS

| | | | | |
|---|---|---|---|---|
| 2,205,967 | A * | 6/1940 | Wise | F41A 9/65 285/916 |
| D745,945 | S | 12/2015 | Kielsmeier et al. | |
| 9,222,739 | B1 | 12/2015 | Bennett et al. | |
| 9,383,152 | B2 * | 7/2016 | Nakayama | F41A 9/70 |
| 9,429,378 | B2 | 8/2016 | Bennett et al. | |
| 9,470,464 | B2 | 10/2016 | Kielsmeier et al. | |
| 2015/0292826 | A1 * | 10/2015 | Kielsmeier | F41A 9/70 42/50 |
| 2015/0345882 | A1 | 12/2015 | Nakayama et al. | |
| 2016/0348992 | A1 * | 12/2016 | Tisone | F41A 9/59 |

* cited by examiner

*Primary Examiner* — Stephen Johnson

(74) *Attorney, Agent, or Firm* — Kevin Keener; Keener and Associates P.C.

(57) ABSTRACT

A follower for a firearm magazine comprising a top side shaped to support a cartridge and a lateral protrusion extending from the follower is disclosed. The lateral protrusion is disposed in an aperture in a wall of a magazine when the follower is disposed at a top position in the magazine. The follower may further comprise a front side disposed in a firing direction and connected to a front portion of top side and a rear side disposed in a rear direction and connected to a rear portion of the top side. The follower may have an elongated arm having a first end connected to the lateral protrusion and a second end connected to a portion of the follower. When the follower reaches the top of the magazine, the lateral protrusion pushes the magazine catch from the magazine and the magazine ejects from the lower receiver.

17 Claims, 9 Drawing Sheets

AUTOMATIC MAGAZINE EJECTION FOLLOWER

PRIORITY

This application is a continuation of U.S. patent application Ser. No. 15/676,029, filed on Aug. 14, 2017, the disclosure of which is hereby incorporated by reference.

FIELD OF THE INVENTION

This invention pertains generally to ammunition magazines for firearms and more specifically to an automatic magazine ejection follower.

BACKGROUND OF INVENTION

Followers are known in the art. A follower is a component situated within a magazine between a lower spring and the ammunition rounds in the magazine. As the rounds are fired from the firearm, the spring pushes the follower up along the body of the magazine, pushing the rounds into the firing chamber for continued firing.

A standard OEM semi-automatic rifle contains a magazine catch assembly. A standard magazine catch assembly is comprised of a magazine catch, a spring, and magazine release button. The magazine catch consists of two ends which occur at a substantially right angle. One end is a threaded screw. The other end is a substantially flat member. When installed in a semi-automatic rifle, the spring is placed over the threaded screw end of the magazine catch. The screw is then inserted through the lower receiver and threaded through the magazine catch button on the opposite side of the lower receiver. The opposite end of the magazine catch rests within a recess in the magazine well receiver. When a magazine is placed in the magazine well the magazine catch slides into a recess in the magazine. The catch holds the magazine in place while the firearm is in use. To release the magazine, a user pushes the magazine release button. When the magazine release button is depressed the magazine catch is lifted from the recess in the magazine and the magazine freely slides out of the magazine well.

When a magazine is empty the user does not know until the user has fired all of the rounds from magazine, including those from the magazine which are in the chamber. So currently when a magazine is empty it is still attached to the lower receiver of the firearm. The user does not become aware that the magazine is empty until the user pulls the trigger and the firearm does not fire. At this point in time then the user pushes the magazine release button. The magazine release button is attached to the magazine catch bar. The magazine catch bar resides in a catch recess in the magazine which prevents the magazine from being removed. Once the magazine catch bar is disengaged then the user removes the empty magazine and replaces it with a full magazine to continue firing.

This process is inefficient. A user is unable to fire the firearm while removing the magazine and attaching a new magazine. What is needed is a device and method whereby the magazine is automatically ejected from the firearm after the last round has left the magazine but is yet to be fired. This would increase the efficiency of use because the user does not have to remove the empty magazine but instead can simply insert the new magazine and continue firing.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof Its sole purpose is to present some concepts in a simplified form as a prelude to the more detailed description that is presented later.

The invention is directed toward a follower for a firearm magazine comprising a top side shaped to support a cartridge and a lateral protrusion extending from the follower. The lateral protrusion is disposed in an aperture in a wall of a magazine when the follower is disposed at a top position in the magazine. The follower may further comprise a front side disposed in a firing direction and connected to a front portion of top side and a rear side disposed in a rear direction and connected to a rear portion of the top side. The follower may also have a bottom side connected to a bottom portion of the front side and connected to a bottom portion of the rear side. The follower may further comprise an elongated arm having a first end connected to the lateral protrusion and a second end connected to a portion of the follower. The follower may further comprise a stop recess disposed in a top portion of the front side. The follower may further comprise a rear protrusion extending from the rear side. The follower may further comprise one or more vertically oriented side fins for engaging a rail in a firearm magazine. The follower may also have a spacer disposed on a top surface of the top side. In some embodiments the follower has a hinge connected to the second end of the elongated arm. In some embodiments the follower has a spring connected to the lateral protrusion.

The invention is also directed toward a firearm comprising an upper receiver, a lower receiver having a magazine well, and a magazine. The magazine comprises a side wall having a magazine catch aperture, a follower disposed within an inner compartment of the magazine, and a spring disposed between the follower and a bottom portion of the magazine. The follower further comprises a top side shaped to support a cartridge and a lateral protrusion extending from the follower. The lateral protrusion is disposed in the magazine catch aperture when the follower is disposed at a top position in the magazine.

The invention is directed toward a method for loading a magazine into a firearm comprising inserting a first magazine into a magazine well of a lower receiver where the first magazine comprises a side wall having a magazine catch aperture, one or more cartridges for firing from the firearm, a follower disposed within an inner compartment of the magazine, and a spring disposed between the follower and a bottom portion of the magazine. The follower further comprises a top side shaped to support a cartridge and a lateral protrusion extending from the follower. The lateral protrusion is disposed in the magazine catch aperture when the follower is disposed at a top position in the magazine.

The method may further comprise firing a firearm until all cartridges are removed from the first magazine, where when all cartridges are removed from the magazine the lateral protrusion enters the magazine catch aperture with sufficient force to remove a magazine catch bar residing in the magazine catch aperture and cause the magazine to fall out of the magazine well. The method may further comprise inserting a second magazine into the magazine well of the lower receiver.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

The invention is an improved follower for a magazine. The follower can be made in any configuration. Similar followers already known in the art include U.S. Pat. No. 9,470,464 (Kielsmeier et al.), U.S. D745,945 (Kielsmeier et al.), U.S. Pat. No. 9,429,378 (Bennett et al.), U.S. D667,915 (Nakayam et al.), U.S. Pat. No. 8,069,601 (Fitzpatrick et al.), U.S. Pat. No. 8,061,071 (Fitzpatrick et al.), and U.S. 2015/0345882 (Nakayama et al.), all of which are hereby incorporated by reference. The current invention can be utilized on any follower type, including the followers disclosed by these references.

Figure 5:
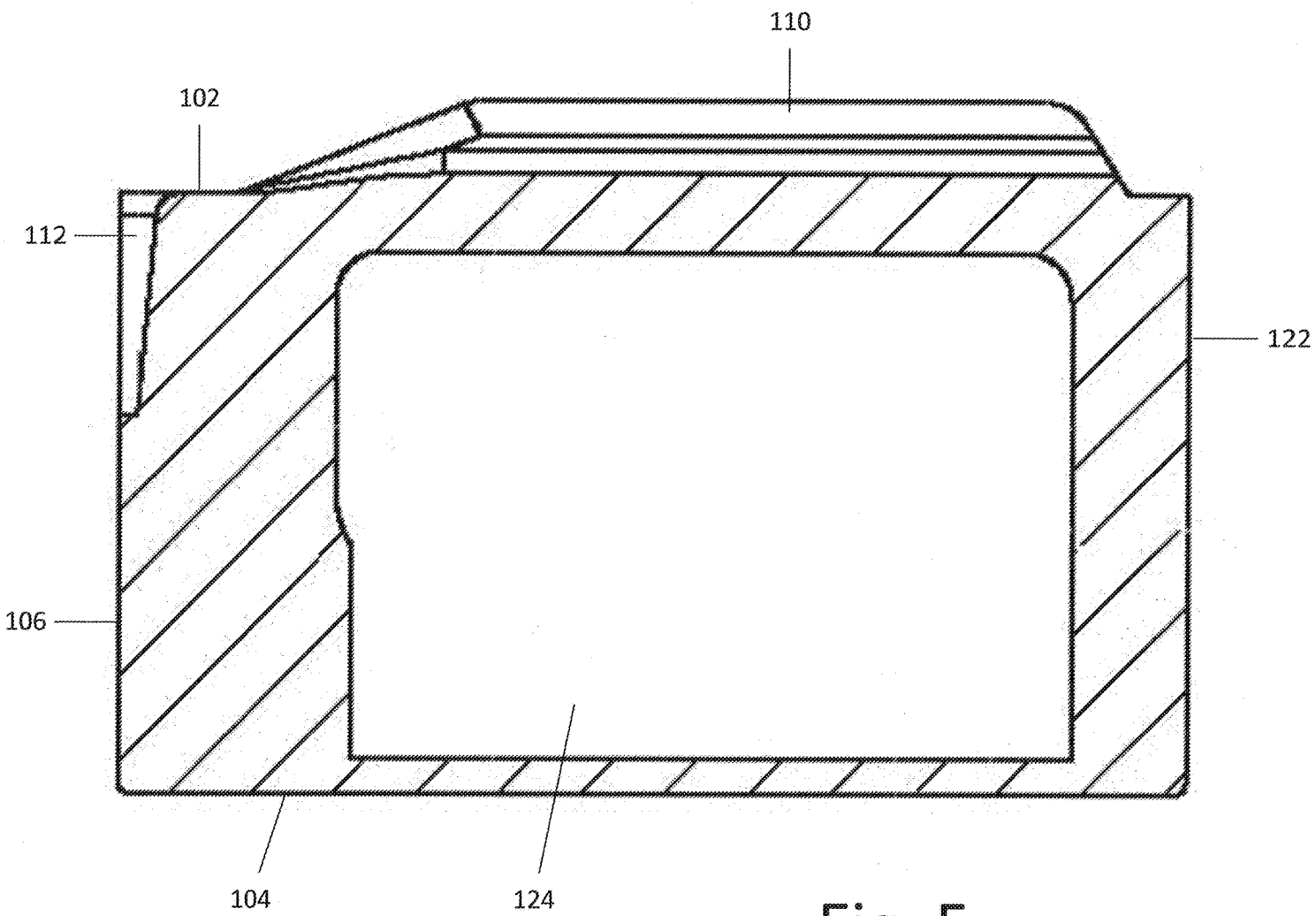
FIG. 5 is a right side cutaway view thereof.
Figure 6:
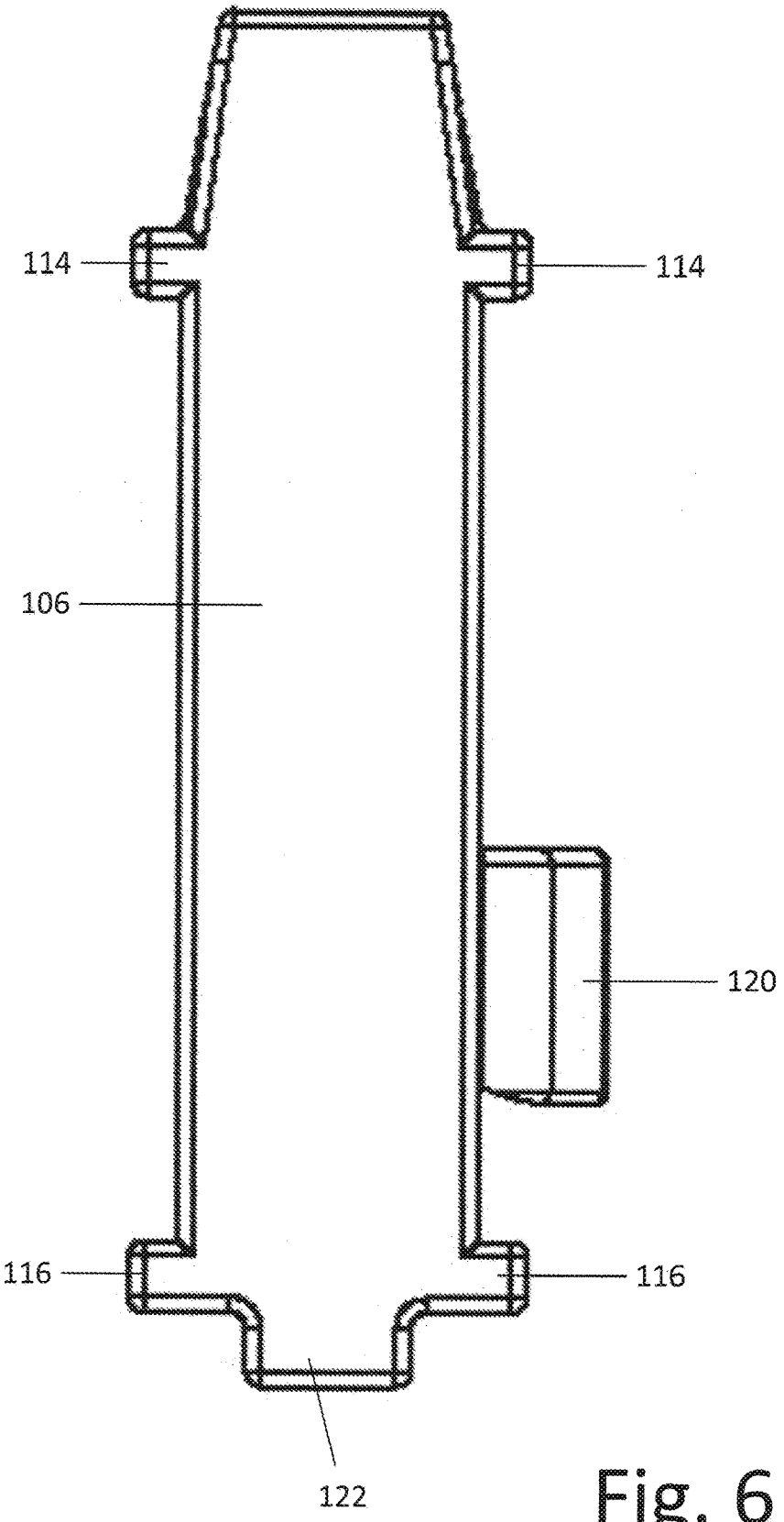
FIG. 6 is a bottom plan view thereof.

Referring to FIGS. 1-6, the preferred embodiment of the follower 100 is displayed. The follower 100 has a top side 102, a bottom side 104, a front side 106, and a rear side 108. While in use in the magazine the top side 102 is disposed towards the firearm, the bottom side 104 is disposed towards the spring in the magazine, the front side 106 is disposed toward the direction of fire, and the rear side 108 is disposed toward the user. The bottom side 104 improves the functionality of the follower 100 over those that do not utilize a bottom side because the bottom side 104 evenly distributes the force of the spring across the follower 100 and prevents the front side 106 and rear side 108 from warping and prevents the entire follower 100 from becoming misaligned in the magazine. As shown in FIG. 6, the preferred embodiment of the bottom side 106 is a flat planar surface for engaging the magazine spring. In other embodiments the bottom side 106 may also have a shaped surface or have one or more downward protrusions for engaging the magazine spring.

Disposed on the top side 102 is a spacer 110. The spacer 110 supports one of the two columns of cartridges in a dual stacked magazine. The spacer 110 may be any size and shape on the top side 102. In the preferred embodiment the spacer 110 is similar in shape to a cartridge and is an elongate member disposed from the rear side 108 toward the front side 106. The spacer 110 may be set on either the left side or the right side of the top side 102.

Disposed on the front side 106 is a stop recess 112. The stop recess 112 may be any size and shape. The stop recess 112 is configured to engage at least a portion of the magazine body to prevent the follower 100 from moving any further upward along the magazine toward the firearm.

Disposed on the rear side 108 is a bolt stop interface 122. In some embodiments the rear side 108 is completely flat and does not have a bolt catch interface 122. In the preferred embodiment the bolt catch interface 112 extends as a protrusion from the rear side 108. The bolt catch interface 122 engages the bolt catch to stop the bolt in the backward position when the magazine is empty. This permits the user to insert a new magazine and load a new round from the new magazine into the chamber.

In the preferred embodiment the follower 100 has a pair of front fins 114 and a pair of rear fins 116. The front fins 114 and rear fins 116 can be any size and shape. The front fins 114 and rear fins 116 engage with grooves or guiderails within the magazine to stabilize the follower 100 within the magazine during use. Alternatively, the front fins 114 and rear fins 116 may fit within linear recesses in the walls of the magazine. These recesses may end in a stop at the upper end so that the follower 100 is not ejected from the end of the magazine when all of the rounds have been fired. In other embodiments there may be any number of front fins 114 and rear fins 116. For instance, there may be no front fin 114 and only a rear fin 116, or vice versa. There may be a front fin 114 or rear fin 116 on only one side of the follower 100. There may be a rear fin 116 only one side of the follower 100.

As shown in FIG. 5, the preferred embodiment of the follower 100 has an internal cavity 124. The internal cavity 124 is defined by the top side 102, bottom side 104, front side 106, and rear side 108. The internal cavity 124 may be any size and shape. In other embodiments the follower 100 does not have an internal cavity 124 but is a single solid component.

Figure 1:
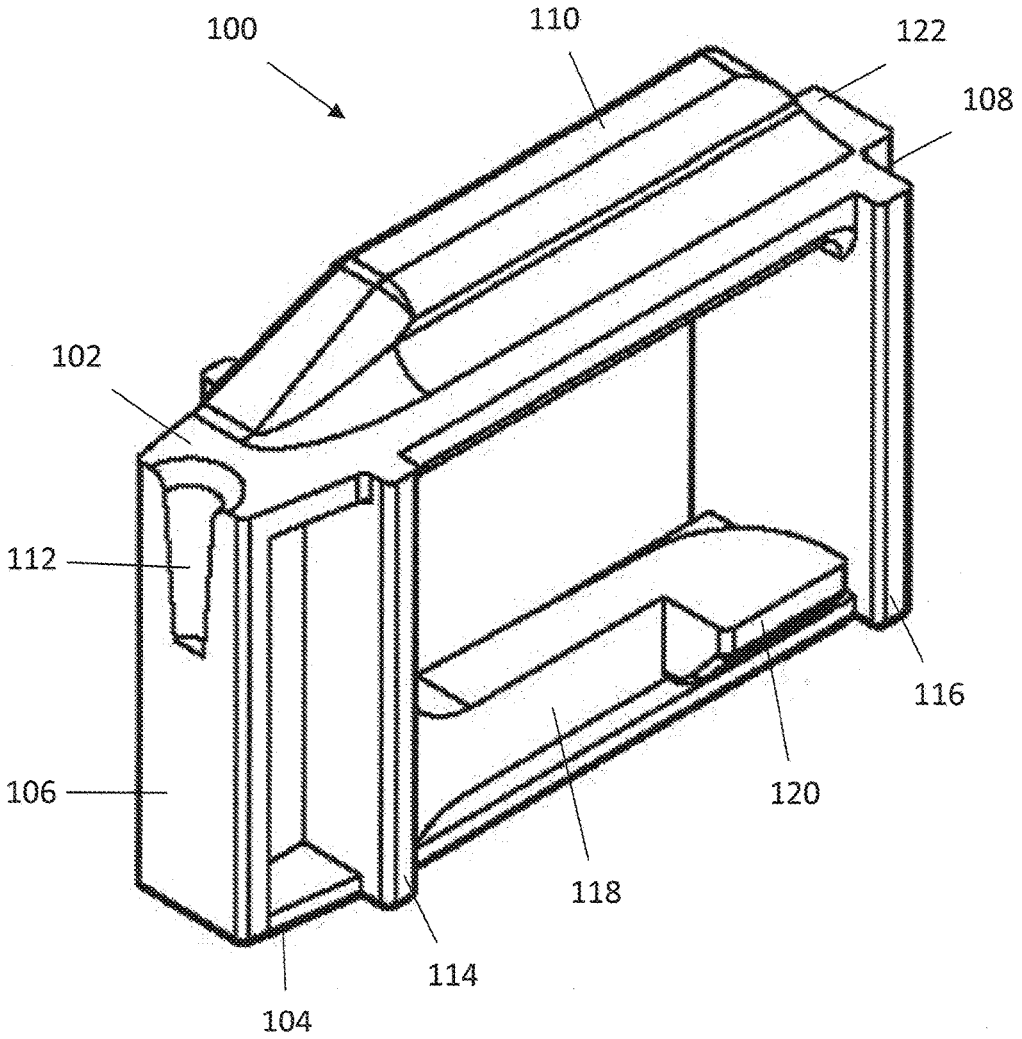
FIG. 1 is a front perspective view of the enhanced magazine follower.
Figure 2:
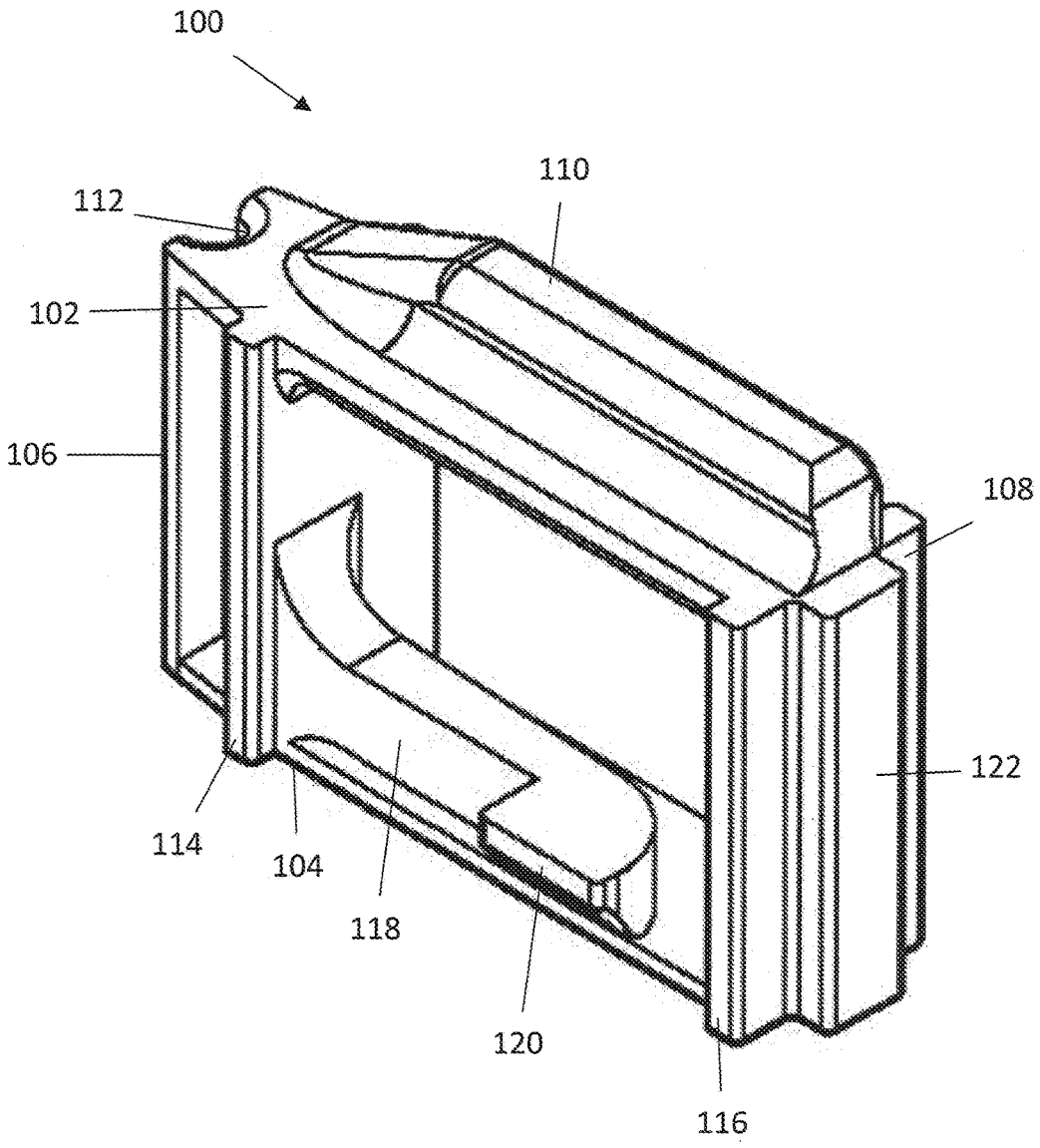
FIG. 2 is a rear perspective view thereof.
Figure 3:
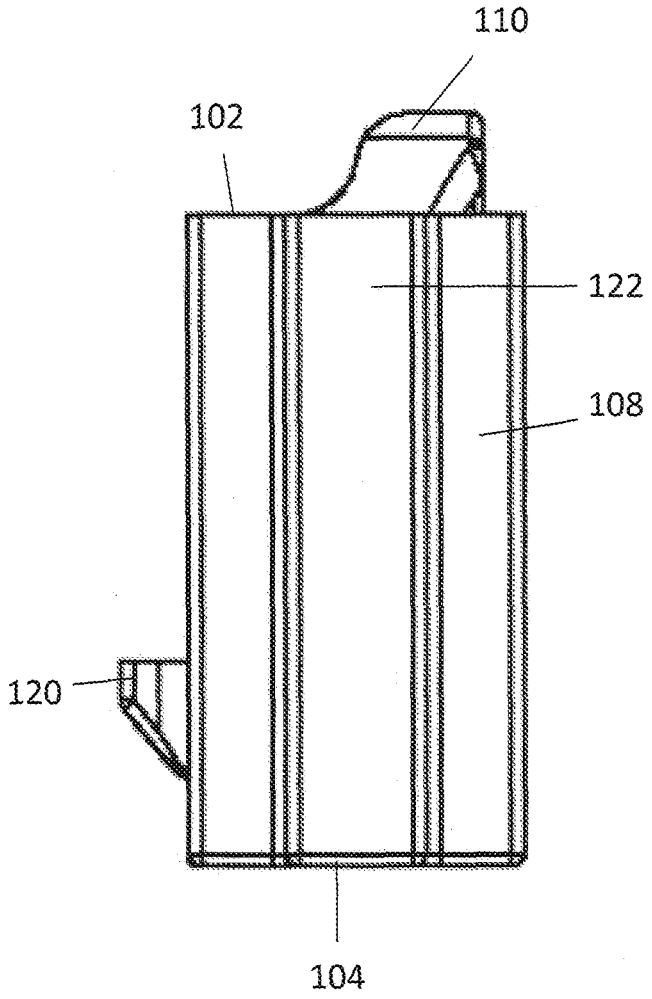
FIG. 3 is rear plan view thereof.
Figure 4:
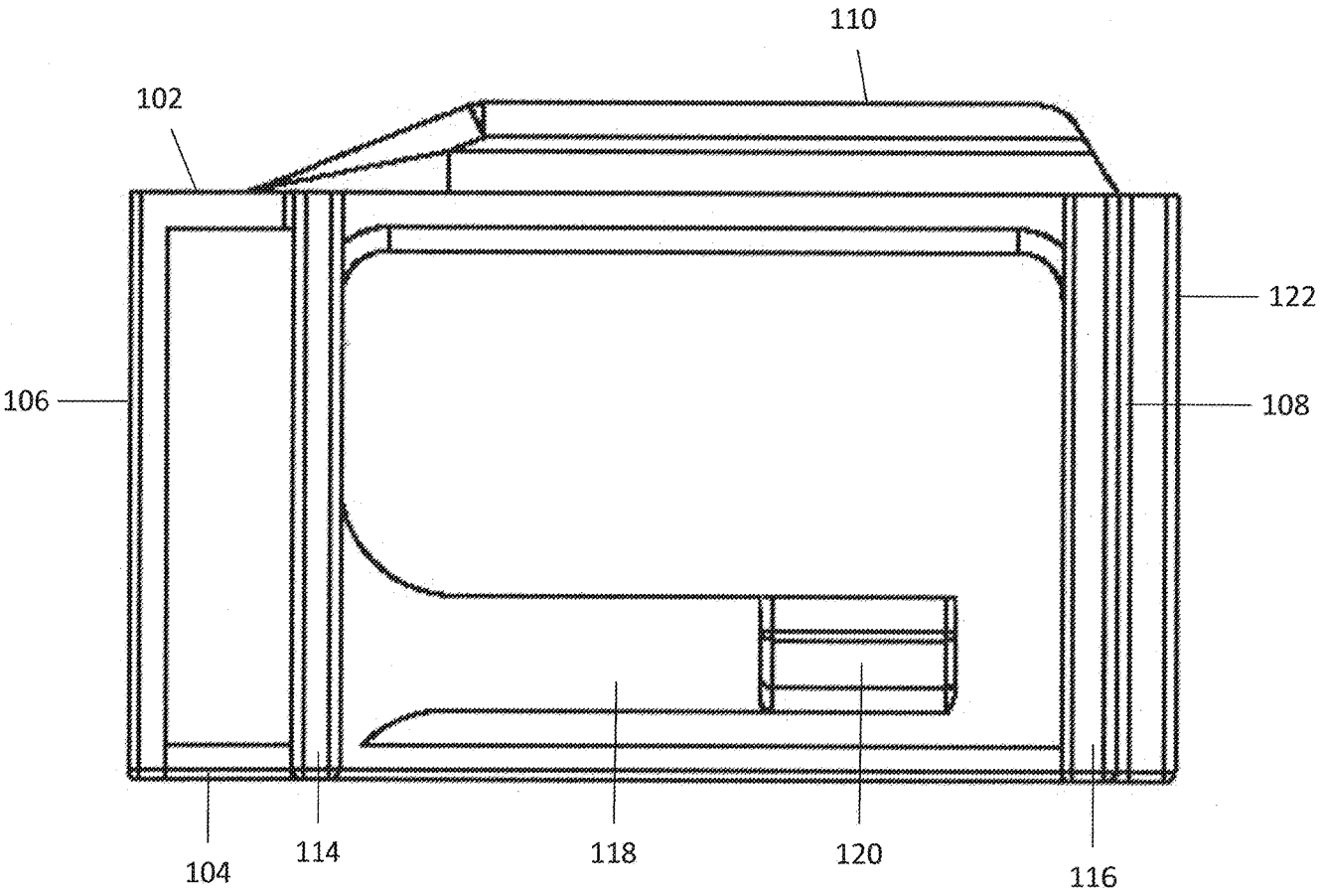
FIG. 4 is a right side view thereof.

In the preferred embodiment the follower 100 has a resilient arm which terminates in a lateral protrusion 120. The resilient arm 118 is attached to a front vertical member which is a part of the front fins 114. In other embodiments the resilient arm 118 may be attached to the top side 102, bottom side 104, front side 106, or rear side 108. The resilient arm 118 is disposed within the internal cavity 124. The resilient arm 118 may be any size and shape. The resilient arm 118 is configured to flex laterally such that the distal end with the lateral protrusion 120 moves inward to the internal cavity 124 and outward from the internal cavity 124. The lateral protrusion 120 may be any size and shape. In the preferred embodiment the lateral protrusion 120 has a triangular profile shape, as shown in FIG. 3, although other profiles and shapes may be utilized. In the preferred embodiment the lateral protrusion 120 extends outward from the main body of the follower 100.

Figure 7:
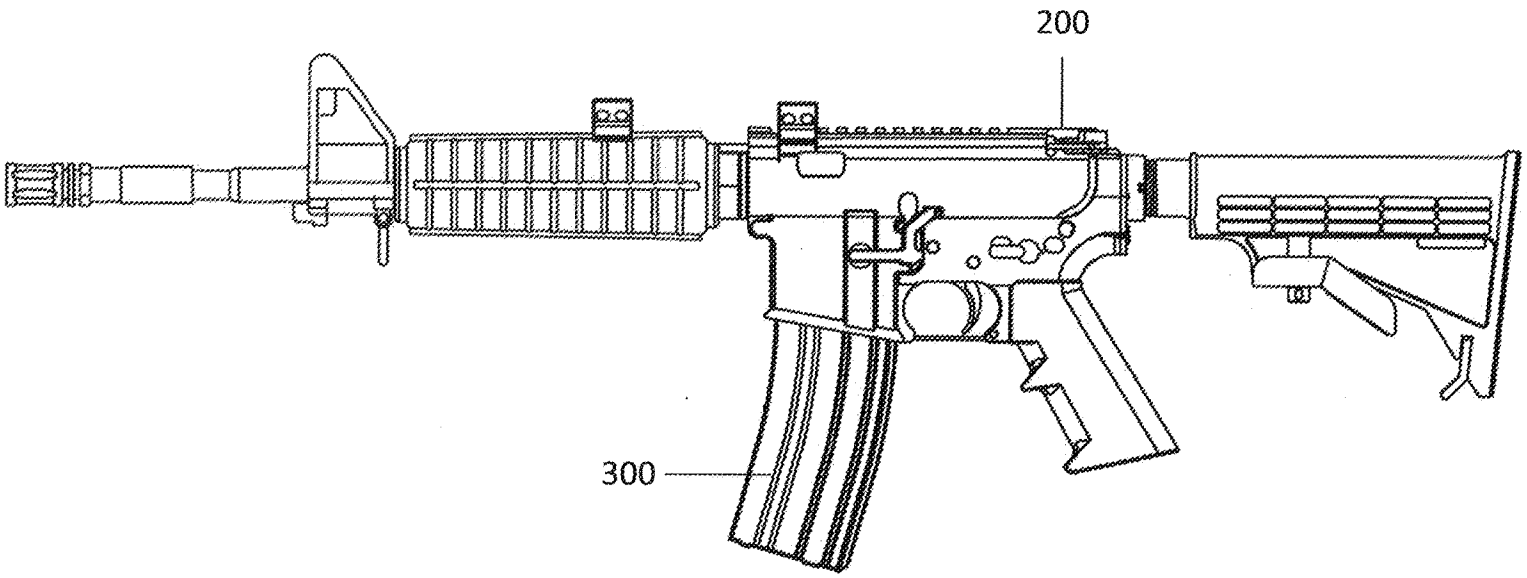
FIG. 7 is a side view of a firearm containing a magazine having the enhanced magazine follower.
Figure 8:
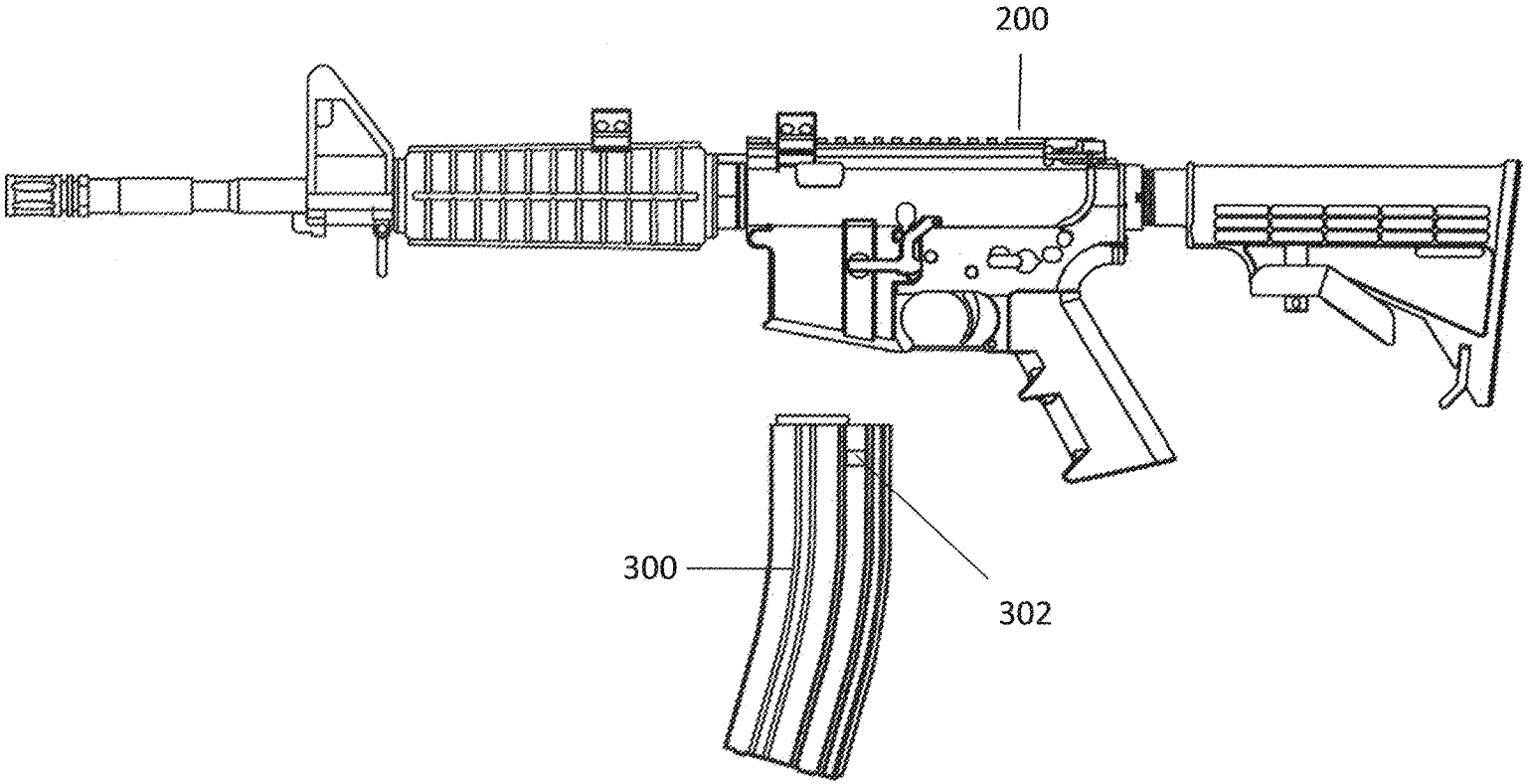
FIG. 8 is a side view of a firearm where the magazine has automatically ejected after the firing of a last round.
Figure 9:
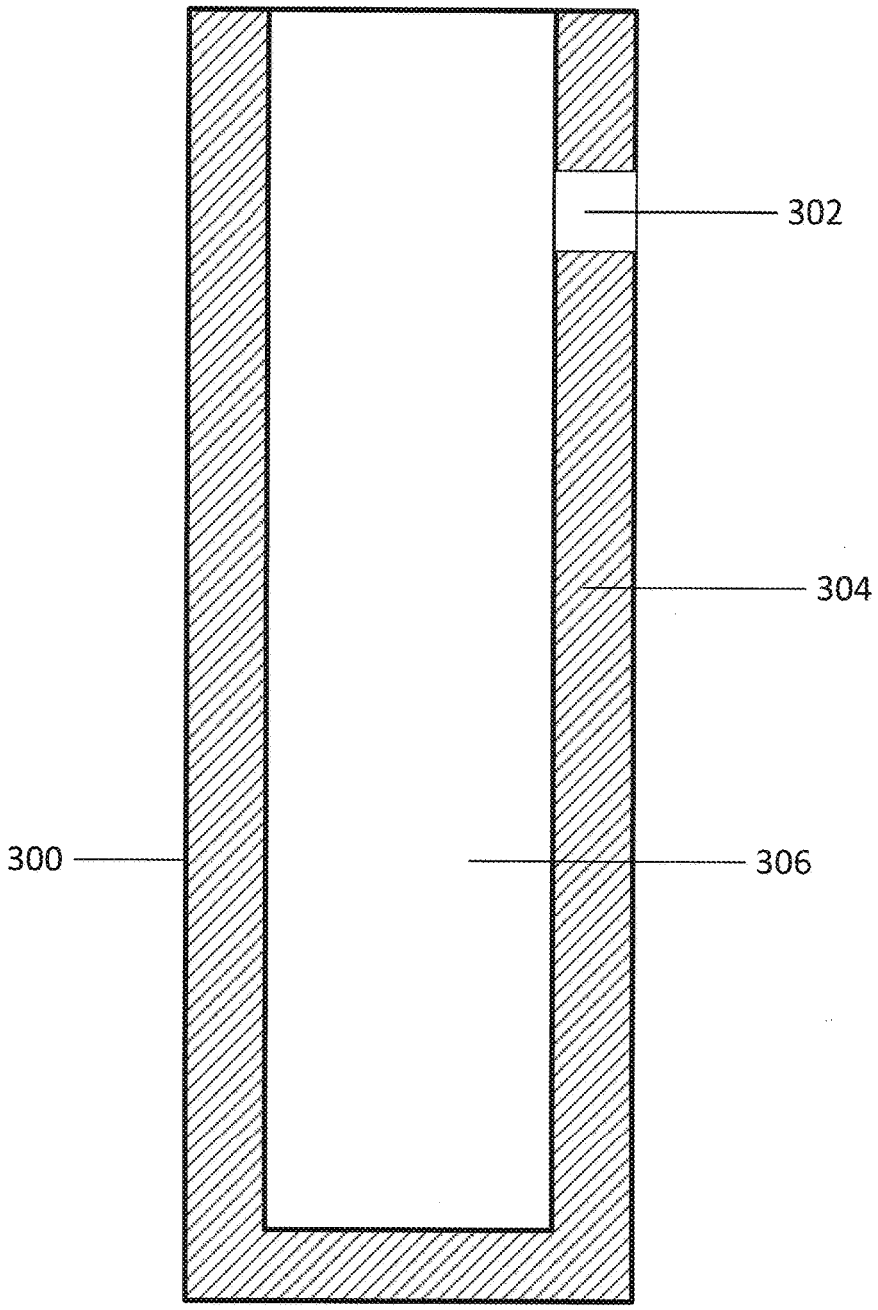
FIG. 9 is a cut away view of a magazine.

Referring to FIGS. 7 and 8, a firearm 200 is shown using a magazine 300 which contains the follower 100. As shown in FIG. 9, the magazine 300 has an aperture 302 in the wall 304 of the magazine 300. When in use the follower 100 is disposed in the internal cavity 306 of the magazine 300.

When the follower 100 is in use in the magazine the lateral protrusion 120 engages the internal side wall 304 of the magazine and is pushed back into the internal cavity 124, causing the resilient arm 118 to deform. While the resilient arm is deformed, the resilient arm 118 is in a first position. After the last round from the magazine is fired the lateral protrusion 120 is positioned to engage an aperture 302 in the wall 304 of the magazine 300. The aperture 302 in the wall 304 of the magazine engages the magazine catch from the magazine catch assembly. When the lateral protrusion 120 engages the aperture 302 the resilient arm 118 returns from its deformed position to a natural position, pushing the lateral protrusion 120 into the aperture 302 in the magazine wall 304. When the resilient arm 118 is in its natural position, and the lateral protrusion 120 is disposed in the aperture 302, the resilient arm 118 is in a second position. The outward lateral force created by the resilient arm 118 causes the lateral protrusion 120 to force the magazine catch outward from the aperture in the magazine wall. Once the magazine catch is disengaged from the magazine, the magazine naturally slides out of the magazine well of the lower receiver. The user can then insert a new magazine into the magazine well without needing to push the magazine release button on the lower receiver.

The invention may take any form. In its simplest form, the invention is any lateral protrusion from a follower 100 which engages an aperture in the magazine wall to force the magazine catch out of the aperture and thereby automatically release the magazine from the magazine well. The follower 100 may be configured as a laterally extending member disposed in a recess in the side of the follower 100. Under the laterally extending member is disposed a spring which pushes the laterally extending member outward to push the magazine catch out of the aperture in the side wall of the magazine and thereby release the magazine from the magazine well. When the follower 100 is positioned lower in the magazine the wall of the magazine pushes the lateral member into the recess and compresses the spring.

In other embodiments of the invention the resilient arm 118 comprises a hinge which permits the resilient arm 118 to pivot laterally, moving the lateral protrusion 120 into and out of the magazine catch aperture.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A follower for a firearm magazine comprising
a) a top side shaped to support a cartridge;
b) an internal cavity disposed below said top side;
c) a flexible elongated arm integral to said follower and having a first end and a second end;
i) wherein said first end has a lateral protrusion extending to a side of said follower,
ii) wherein said second end is connected to an inner portion of said follower, wherein said inner portion of said follower is disposed below said top side of said follower;
d) wherein said flexible elongated arm flexes between a first position and a second position;
e) wherein when in said first position said lateral protrusion engages an internal side wall of said firearm magazine and said flexible elongated arm is disposed within said internal cavity; and
f) wherein when in said second position said flexible elongated arm is disposed outside of said internal cavity and said lateral protrusion is disposed in an aperture in a wall of said firearm magazine when said follower is disposed at a top position in said magazine.

2. The follower as in claim 1 further comprising
a) a front side disposed in a firing direction and connected to a front portion of said top side; and
b) a rear side disposed in a rear direction and connected to a rear portion of said top side.

3. The follower as in claim 2 further comprising a bottom side connected to a bottom portion of said front side and connected to a bottom portion of said rear side.

4. The follower as in claim 3 further comprising a stop recess disposed in a top portion of said front side.

5. The follower as in claim 4 further comprising a rear protrusion extending from said rear side.

6. The follower as in claim 5 further comprising one or more vertically oriented side fins for engaging a rail in said firearm magazine.

7. The follower as in claim 6 further comprising a spacer disposed on a top surface of said top side.

8. The follower as in claim 2 further comprising a rear protrusion extending from said rear side.

9. The follower as in claim 2 further comprising a stop recess disposed in a top portion of said front side.

10. The follower as in claim 1 further comprising a spacer disposed on a top surface of said top side.

11. The follower as in claim 1 further comprising a hinge connected to said second end of said elongated arm and said inner portion of said follower.

12. The follower as in claim 1 further comprising a spring connected to said lateral protrusion.

13. The follower as in claim 1 further comprising one or more vertically oriented side fins for engaging a rail in said firearm magazine.

14. A firearm comprising a) an upper receiver;

b) a lower receiver having a magazine well;

c) a magazine further comprising i) a side wall having a magazine catch aperture;

ii) a follower disposed within an inner compartment of said magazine, said follower further comprising (1) a top side shaped to support a cartridge;

(2) an internal cavity disposed below said top side;

(3) a flexible elongated arm integral to said follower and having a first end and a second end;

(a) wherein said first end has a lateral protrusion extending to a side of said follower, (b) wherein said second end is connected to an inner portion of said follower, wherein said inner portion of said follower is disposed below said top side of said follower;

(4) wherein said flexible elongated arm flexes between a first position and a second position;

(5) wherein when in said first position said lateral protrusion engages an internal side wall of said firearm magazine and said flexible elongated arm is disposed within said internal cavity; and (6) wherein when in said second position said flexible elongated arm is disposed outside of said internal cavity and said lateral protrusion is disposed in an aperture in a wall of said firearm magazine when said follower is disposed at a top position in said magazine.

15. A method for loading a magazine into a firearm comprising a) inserting a first magazine into a magazine well of a lower receiver i) wherein said first magazine comprises (1) a side wall having a magazine catch aperture;

(2) one or more cartridges for firing from said firearm;

(3) a follower disposed within an inner compartment of said magazine, said follower further comprising (a) a top side shaped to support a cartridge;

(b) an internal cavity disposed below said top side;

(c) a flexible elongated arm integral to said follower and having a first end and a second end;

(i) wherein said first end has a lateral protrusion extending to a side of said follower, (ii) wherein said second end is connected to an inner portion of said follower, wherein said inner portion of said follower is disposed below said top side of said follower;

(d) wherein said flexible elongated arm flexes between a first position and a second position;

(e) wherein when in said first position said lateral protrusion engages an internal side wall of said firearm magazine and said flexible elongated arm is disposed within said internal cavity; and (f) wherein when in said second position said flexible elongated arm is disposed outside of said internal cavity and said lateral protrusion is disposed in an aperture in a wall of said firearm magazine when said follower is disposed at a top position in said magazine.

16. The method as in claim 15 further comprising a) firing a firearm until all cartridges are removed from said first magazine;

b) whereby when all cartridges are removed from said magazine said lateral protrusion enters said magazine catch aperture with sufficient force to remove a magazine catch bar residing in said magazine catch aperture and cause said magazine to fall out of said magazine well.

17. The method as in claim 16 further comprising inserting a second magazine into said magazine well of said lower receiver.

* * * * *